United States Patent [19]

Petersen

[11] 4,192,549

[45] Mar. 11, 1980

[54] WEEELCHAIR TILT CRADLE

[76] Inventor: John F. Petersen, 9911 SE. Mt. Scott Blvd., Portland, Oreg. 97266

[21] Appl. No.: 933,153

[22] Filed: Aug. 14, 1978

[51] Int. Cl.[2] ..... A47C 31/00; A47C 13/00

[52] U.S. Cl. ..... 297/464; 248/143; 297/DIG. 4; 297/130

[58] Field of Search ..... 248/143, 139, 371, 372, 248/398, 395; 269/323, 328; 214/1 A, DIG. 13, 130, 130 C; 280/30, 31, 32, 7.1; 5/83; 297/DIG. 4, 384, 130

[56] References Cited

U.S. PATENT DOCUMENTS

| | | | |
|---|---|---|---|
| 2,591,911 | 4/1952 | Block | 297/384 X |
| 3,093,387 | 6/1963 | O'Neill | 280/47.12 X |
| 3,114,492 | 1/1964 | Christensen | 5/83 |
| 3,424,493 | 1/1969 | Gottfried et al. | 297/384 |
| 3,476,404 | 11/1969 | Rachman | 297/DIG. 4 |
| 3,662,737 | 6/1976 | James | 5/81 R |
| 3,702,660 | 11/1972 | Berger | 248/143 X |
| 4,016,005 | 4/1977 | DiMatteo | 297/DIG. 4 |

*Primary Examiner*—James T. McCall
*Attorney, Agent, or Firm*—Oliver D. Olson

[57] ABSTRACT

A tiltable support for a wheelchair includes a main base for supporting a wheelchair, an angular base section for supporting the wheelchair in a rearwardly tilted position, and a back rest for supporting the back of the wheelchair while in the tilting position. In one embodiment, the support may be moved manually between one position in which the main base rests upon an underlying horizontal support, for disposing a wheelchair patient in an upright sitting position, and a second position in which the angular base rests upon the horizontal underlying support for disposing the wheelchair patient in a rearwardly reclining position. In a second embodiment, power driven mechanism is integrated with the support for moving it between the upright and reclining positions of the wheelchair patient.

9 Claims, 6 Drawing Figures

WEEELCHAIR TILT CRADLE

BACKGROUND OF THE INVENTION

This invention relates to wheelchairs, and more particularly to a cradle structure by which to enable the tilting of a wheelchair between upright and rearwardly tilted positions.

It is recognized that many benefits accrued to wheelchair patients when they are able to be adjusted periodically from an upright sitting position to a reclining position. The patient derives a feeling of relaxation. The reclining position also eases pressure points and improves circulation and hence reduces swelling in the legs and feet.

However, wheelchair patients heretofore have not been able to be adjusted to a reclining position without having a specially designed wheelchair. Accordingly, wheelchair patients heretofore have had to remain in an upright sitting position until transferred from the wheelchair to a bed or reclining chair. The latter requires the cooperative physical effort usually of at least two trained persons. Hence, most wheelchair patients are left for long periods of time in the upright sitting position.

SUMMARY OF THE INVENTION

In its basic concept, this invention provides an adjustable cradle for supporting a wheelchair for adjustment of a wheelchair patient between an upright sitting position and a reclining position.

It is by virtue of the foregoing basic concept that the principal objective of this invention is achieved; namely, to enable wheelchair patients to be adjusted to a reclining position while being retained in conventional wheelchairs.

Another objective of this invention is the provision of a wheelchair tilt cradle of the class described which is adjustable manually between upright and reclining positions of a patient by minimum physical effort of one person.

Still another objective of this invention is to provide a wheelchair tilt cradle of the class described which is adjustable between upright and reclining positions of a wheelchair patient by power driven mechanism which may be controlled by the patient or by an attendant.

A further objective of this invention is the provision of a wheelchair tilt cradle of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
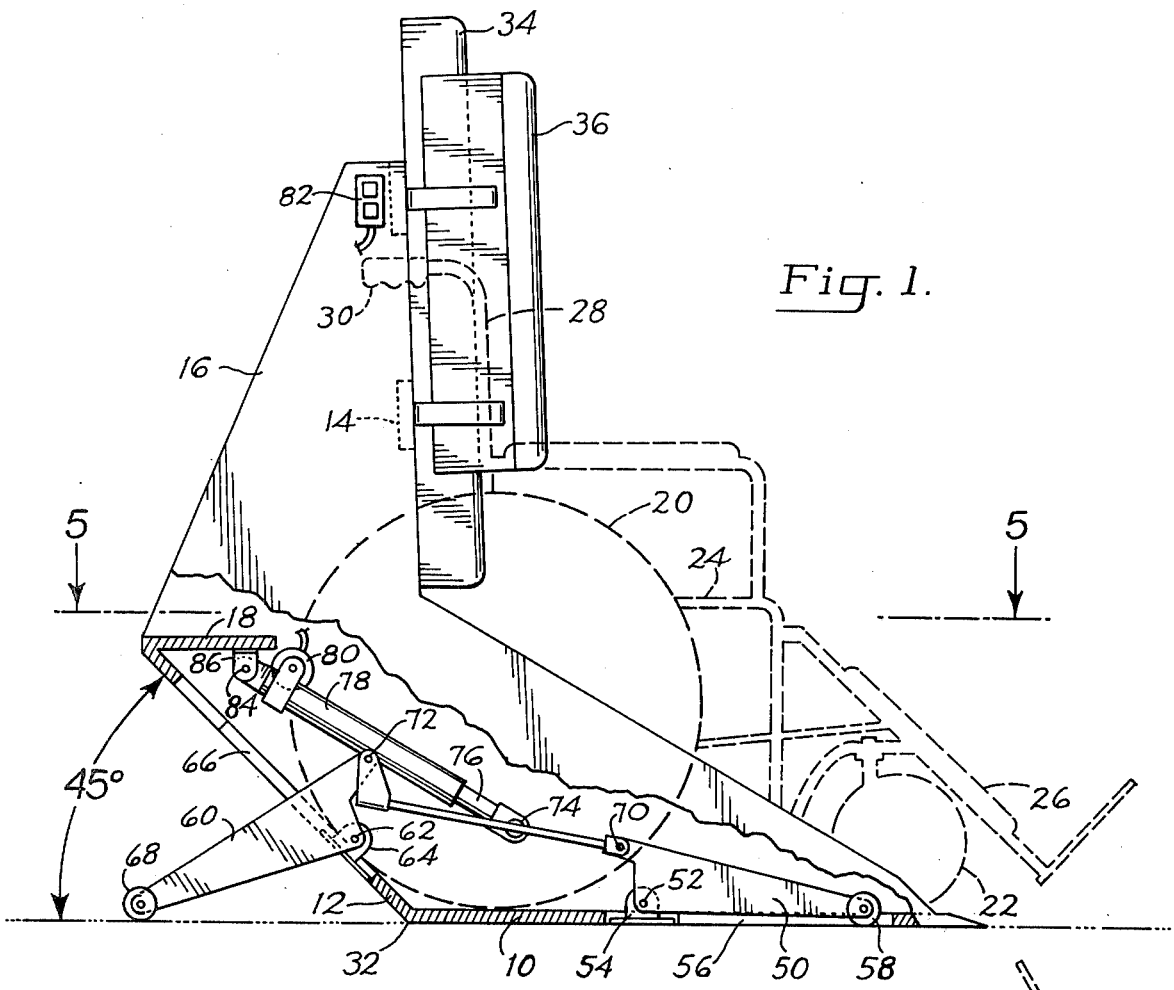
FIG. 1 is a side elevation of a wheelchair tilt cradle embodying the features of this invention, the same being shown in positions supporting a wheelchair in the upright sitting position of a patient, parts being broken away to disclose details of internal construction.
Figure 2:
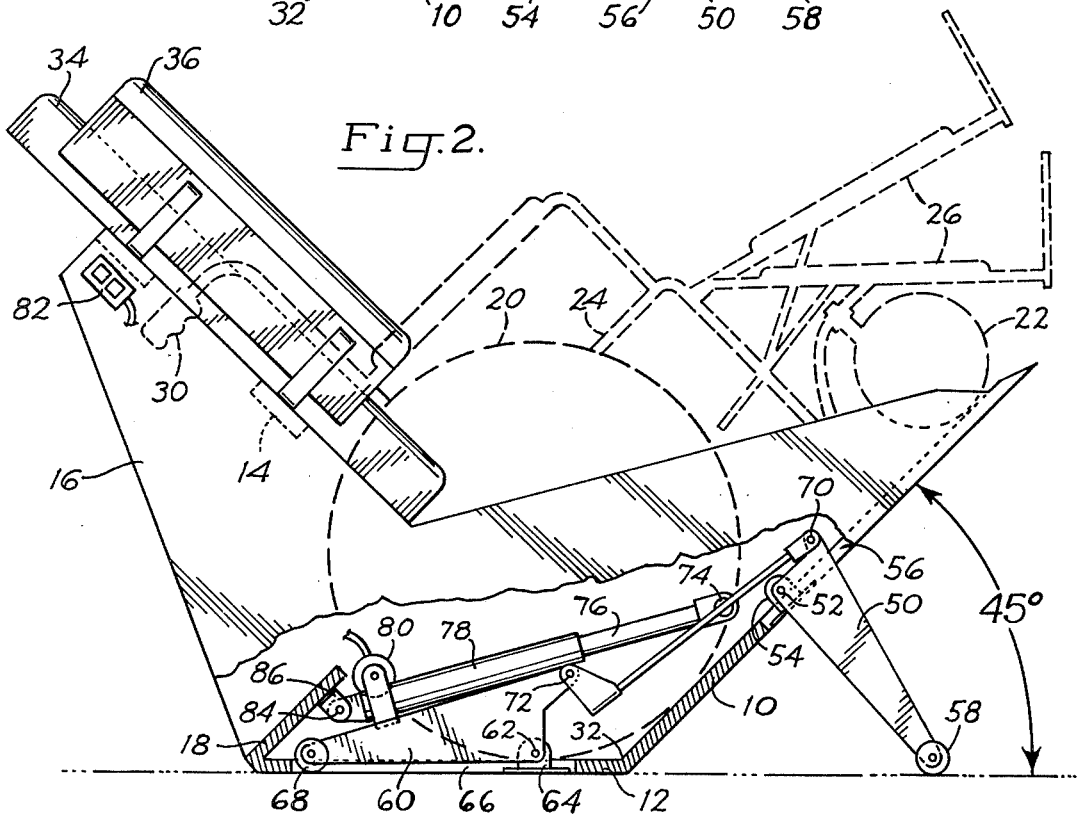
FIG. 2 is a side elevation similar to FIG. 1 showing the wheelchair tilt cradle adjusted to a tilted position for supporting a wheelchair patient in reclining position.
Figure 3:
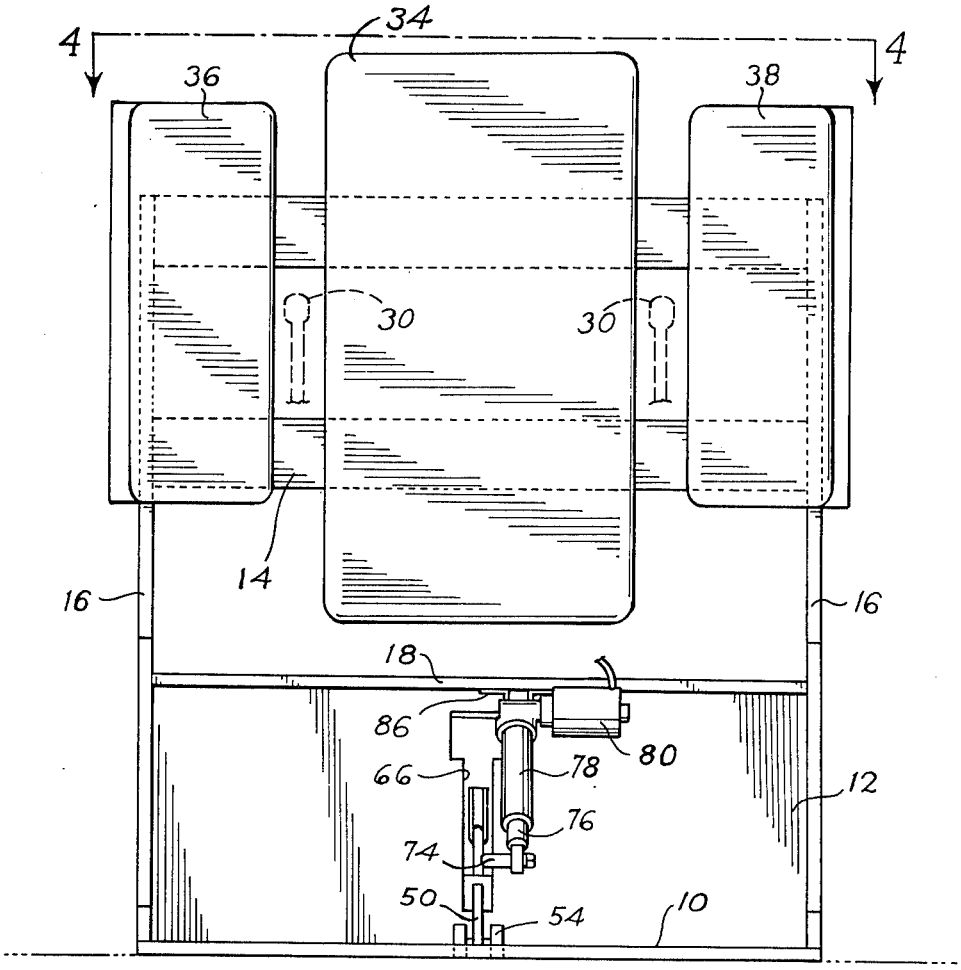
FIG. 3 is a front elevation of the wheelchair tilt cradle illustrated in FIG. 1.
Figure 4:
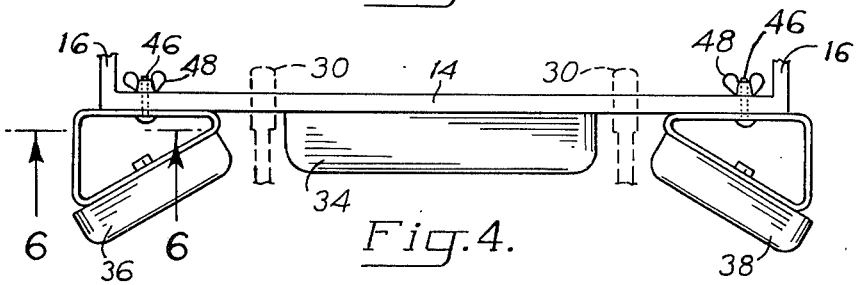
FIG. 4 is a fragmentary sectional view taken on the line 4—4 in FIG. 3.
Figure 6:
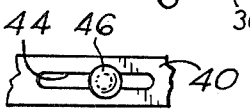
FIG. 6 is a fragmentary vertical elevation as viewed in the direction of arrows 6—6 in FIG. 4.
Figure 5:
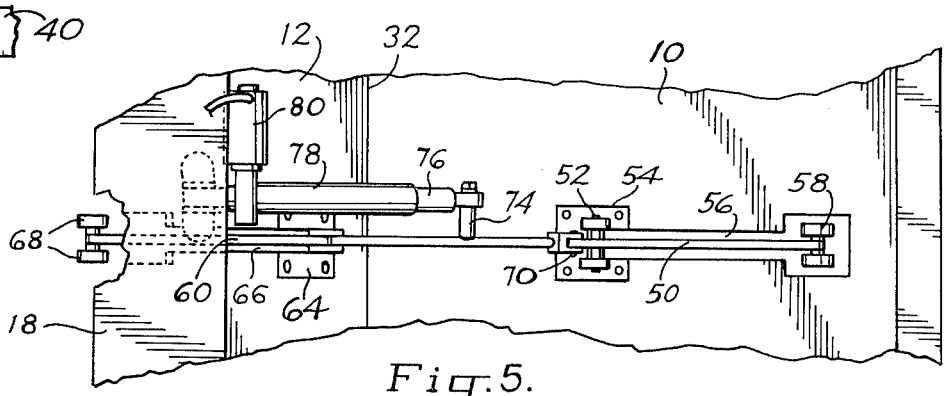
FIG. 5 is a fragmentary plan view in the direction of arrows 5—5 in FIG. 1.

The wheelchair tilt cradle of this invention broadly comprises a frame arranged to removably support a wheelchair and to be adjusted between positions in which a wheelchair patient is disposed in a substantially upright sitting position (FIG. 1) and in a rearwardly tilted, reclining position (FIG. 2).

In the embodiment illustrated, the frame includes a main base member 10, an angular tilt base member 12 and a back support member 14, all secured between laterally spaced side walls 16. A transverse plate 18 also is provided at the rear side of the cradle, for a dual purpose described hereinafter.

The main base member is arranged to removably receive a wheelchair of any standard construction. Thus, the wheelchair may be of manual or power-drive type. As illustrated, such conventional wheelchairs include a pair of laterally spaced rear drive wheels 20 of large diameter and a pair of laterally spaced front caster wheels 22 of small diameter. The wheels support the chair components which include the seat 24, the leg rest 26 and the back rest 28 which supports a pair of laterally spaced handles 30.

The angular base member 12 extends angularly upward and rearward from the main base member and forms with the latter an included angle chosen to provide a desired reclining angle for a patient. As illustrated, the included angle is about 135°. This enables a wheelchair patient to be adjusted from a substantially upright sitting position (FIG. 1) to a rearward reclining angle of about 45° (FIG. 2), by swinging the cradle about the transverse axis of the apex 32 of said included angle. It will be understood, however, that the included angle between the main and angular base members may vary substantially, so long as it is greater than 90° and less than 180°.

The back support member 14 is disposed above the base members and functions as an abutment for the back rest component of the wheelchair. Accordingly, the lower end of the back support member terminates above the large diameter rear wheels of the wheelchair so as to allow the latter to extend rearwardly into abutment with the angular base member 12.

In the embodiment illustrated, the back support member mounts a central, vertically elongated resilient back rest pad 34 and a pair of side pads 36 and 38, for supporting the back, head and arms of a wheelchair patient when in the reclining position. The side pads are adjustable laterally relative to the central pad to accommodate patients of diverse sizes. The adjustment is provided in the embodiment illustrated by upper and lower triangular frame members 40 secured to each side pad as by bolts 42 and each provided with a laterally elongated slot 44 receiving freely therethrough a clamp bolt 46 extending through a hole in the back support member. Wing nuts 48 on the bolts facilitates the adjustment.

A pair of laterally spaced openings are provided in the back support member to accommodate the free passage of the handles 30 of the wheelchair which project rearwardly of the back rest 28 and extend through the spaces between the center pad 34 and the side pads 36 and 38.

The tilt cradle as described hereinbefore is operable manually, with minimum effort of a single person, for movement between the upright sitting position illustrated in FIG. 1 and the reclining position illustrated in FIG. 2. Thus, assuming a patient is seated in upright position in a conventional wheelchair and the tilt cradle is adjusted to the position illustrated in FIG. 1, the wheelchair is backed into the cradle where its wheels are supported on the main base member 10, the back rest 28 abuts the pad 34 on the back support member and the handles 30 project rearwardly through the registering openings in the back support member and pads. The attendant then moves to a position behind the cradle, grasps the two handles 30 of the wheelchair and pulls rearwardly and downwardly thereon. Additional downward force may be applied by the attendant by momentarily standing on the transverse plate 18. The cradle thus is tilted in the counterclockwise direction about the transverse axis of the apex 32, to the position illustrated in FIG. 2.

In the tilted position of the cradle the angular base member 12 is brought into engagement with the underlying horizontal support, usually the floor of a hospital, rest home, personal home and the like. The main base member 10, which normally rests upon the underlying horizontal support, now is inclined forwardly. In this manner the wheelchair is tilted rearwardly so that the patient is in a reclining position. The transverse plate 18 serves as an abutment for the rear wheels of the wheelchair to limit further rearward movement of the latter from the position illustrated in FIG. 2.

As illustrated in FIG. 2, the leg rest component 26 of the wheelchair may be adjusted from the normally retracted position of FIG. 1 to an upwardly extended position in which the patient's legs are brought to a more straightened condition than in the sitting position of FIG. 1.

In the preferred embodiment illustrated, power driven means is provided for adjusting the cradle between the upright and reclining positions of FIGS. 1 and 2, respectively. This enables the cradle to be adjusted without the physical effort of an attendant and, indeed, enables the patient to make the adjustment without assistance.

The power means illustrated comprises a back tilt lever 50 mounted pivotally intermediate its ends on a pivot shaft 52 supported by brackets 54 secured to the main base member. The lever is aligned with a correspondingly elongated slot 56 in the main base member, to enable the lever to swing through the plane of the main base member, as described more fully hereinafter. The forward end of the lever is provided with a pair of rollers 58 for bearing against the underlying floor.

The power means also includes a forward tilt lever 60 mounted pivotally intermediate its ends on a shaft 62 supported by brackets 64 extending upwardly from the angular base member 12. An elongated slot 66 in the angular base member registers with the forward tilt lever to allow the latter to swing through the plane of the angular base member. This member also is provided at its outer end with a pair of rollers 68 for engagement with the supporting floor.

The back and forward tilt levers are connected to extensible power means for simultaneous pivoting in the appropriate directions to effect adjustment of the cradle to the upright and reclining positions described hereinbefore. As illustrated, a bell crank lever is connected at one end pivotally, by a pivot pin 70, to the back tilt lever 50 and at its opposite end pivotally, by a pivot pin 72, to the forward tilt lever 60.

A pivot shaft 74 intermediate the ends of the bell crank lever connects the latter pivotally to the extensible rod 76 of an extensible power unit. The rod may be the piston rod projecting from one end of the associated cylinder of an extensible hydraulic piston-cylinder unit which is supplied with hydraulic fluid under pressure by means of an hydraulic pump driven by an electric motor. Alternatively, and as illustrated, the rod may be the extensible elongated screw of a conventional screw jack 78 which includes a worm driven by an electric drive motor 80.

An electric control switch 82 for the electric drive motor is positioned on the cradle, as by mounting on one of the side walls, for convenient access of the patient supported in the wheelchair.

As illustrated, the end of the screw jack housing 78 opposite the extensible screw 76 is connected pivotally, by a pivot shaft 84, to a bracket 86 mounted on the cradle frame. Conveniently, this bracket is mounted on the underside of the transverse plate 18 described hereinbefore.

The operation of a power-driven assembly is as follows: With the components adjusted to the position illustrated in FIG. 1, the electric motor 80 is activated to effect extension of the elongated rod 76 and thus the back and forward tilt levers and 60, respectively, to rotate clockwise about their mounting pivots. Since the back tilt lever 50 engages the underlying horizontal floor, the force tending to rotate it clockwise about its pivot 52 results in elevation of the main base member 10 angularly forward about the line 32 of juncture with the angular base member 12.

Simultaneous clockwise rotation of the forward tilt lever 60 accommodates the rearward tilting of the cradle frame, until it reaches the position illustrated in FIG. 2. In this position the back tilt lever 50 has swung downward through the slot 56 in the main base member to the fully extended position illustrated, while the forward tilt lever 60 has swung upward through the slot 66 in the angular base member 12 to the retracted position illustrated. The patient thus is adjusted to the reclining position.

To return the patient to the upright sitting position illustrated in FIG. 1, the electric drive motor 80 is operated to effect retraction of the extended rod 76 from the position illustrated in FIG. 2 to the position illustrated in FIG. 1. This results in counterclockwise rotation of the back and forward tilt levers 50 and 60, respectively, the counterclockwise rotation of the forward tilt lever 60 causing the cradle frame to rotate clockwise about the line 32 of juncture of the main and angular base members, to the position of FIG. 1.

It is an advantageous feature of the power driven embodiment of this invention that any reclining angle may be selected between the limits of FIG. 1 and 2, since the power driven mechanism may be stopped in any position intermediate those limits.

From the foregoing it will be appreciated that the present invention provides novel means by which a wheelchair patient may be moved, whenever desired, between an upright sitting position and a rearwardly reclining position, while remaining in a conventional wheelchair. The tilt cradle is of simplified construction for economical manufacture. The manually operable embodiment of the invention is available at minimum cost, while the power driven embodiment affords the advantages of self-operation and a greater range of reclining angles.

It will be apparent to those skilled in the art that various changes may be made in the size, shape, type, number and arrangement of parts deacribed hereinbefore, without departing from the spirit of this invention.

Having described my invention and the manner in which it may be used, I claim:

1. A wheelchair tilt cradle, comprising an angular frame forming two sections disposed angularly with respect to each other and arranged to removably support a wheelchair, the frame being adjustable angularly to place each section selectively in engagement with an underlying floor, whereby in one of said adjusted positions a wheelchair patient is disposed in a substantially upright sitting position and in the other said adjusted positions the wheelchair patient is disposed in a rearwardly tilted, reclining position.

2. The wheelchair tilt cradle of claim 1 including power driven lever means on the frame arranged to engage an underlying floor for moving the frame between said positions of adjustment.

3. A wheelchair tilt cradle, comprising a frame arranged to removably support a wheelchair and to be adjustable between positions in which a wheelchair patient is disposed in a substantially upright sitting position and in a rearwardly tilted, reclining position, the frame including (a) a main base member arranged to removably receive a wheelchair, (b) an angular base member extending angularly upward and rearward from the main base member, (c) a back support member arranged for abutment by the back of a wheelchair, and (d) side walls at the opposite ends of the base and back support members, (e) the frame being adjustable between a position in which the main base member is in horizontal position for supporting a wheelchair patient in upright sitting position and a position in which the main base member inclines forwardly from the angular base member for supporting a wheelchair patient in a reclining position.

4. The wheelchair tilt cradle of claim 3 wherein the back support member has openings for receiving therethrough the handles of a wheelchair.

5. The wheelchair tilt cradle of claim 3 including:

(a) a back tilt lever mounted pivotally on the frame for movement through the plane of the main base member, (b) a forward tilt lever mounted pivotally on the frame for movement through the plane of the angular base member, and (c) power means connected to the back and forward tilt levers for pivoting the levers in the directions to effect said adjustments of the frame.

6. The wheelchair tilt cradle of claim 5 wherein the power means comprises an extensible power unit interconnecting the tilt levers for simultaneous pivoting.

7. The wheelchair tilt cradle of claim 5 including a bell crank lever interconnecting the tilt levers, and the power means comprises an extensible power unit interconnecting the frame and bell crank lever.

8. The wheelchair tilt cradle of claim 3 including a central resilient back rest pad and a pair of resilient side pads secured in laterally spaced position to the back support member, the back support member having an opening registering with the spaces between the central and side pads for receiving the handles of a wheelchair freely therethrough.

9. The wheelchair tilt cradle of claim 8 including means for securing the side pads to the back support member for lateral adjustment relative to the central pad.

* * * * *